US007449144B2

(12) United States Patent
Latz et al.

(10) Patent No.: US 7,449,144 B2
(45) Date of Patent: Nov. 11, 2008

(54) PROCESS FOR MANUFACTURING A SLIDING CONTACT PIECE FOR MEDIUM TO HIGH CURRENT DENSITIES

(75) Inventors: Wilhelm Latz, Frankfurt am Main (DE); Jürgen Spangenberg, Bad Vilbel (DE); Arwed Uecker, Farmville, VA (US)

(73) Assignee: Deutsche Carbone AG, Frankfurt am Main (DE)

( * ) Notice: Subject to any disclaimer, the term of this patent is extended or adjusted under 35 U.S.C. 154(b) by 318 days.

(21) Appl. No.: 10/346,824

(22) Filed: Jan. 17, 2003

(65) Prior Publication Data

US 2003/0135993 A1 Jul. 24, 2003

(51) Int. Cl.
*B22F 3/12* (2006.01)

(52) U.S. Cl. ..... 419/11; 419/32; 419/36; 419/38; 419/53; 419/58

(58) Field of Classification Search ..... 419/32, 419/36, 38, 53, 58, 35–37, 54, 11, 30
See application file for complete search history.

(56) References Cited

U.S. PATENT DOCUMENTS

| | | | | | |
|---|---|---|---|---|---|
| 1,067,003 | A | * | 7/1913 | Deats et al. | 419/11 |
| 2,252,277 | A | * | 8/1941 | Tate et al. | 252/503 |
| 2,411,060 | A | * | 11/1946 | Savage | 75/233 |
| 4,000,981 | A | * | 1/1977 | Sugafuji et al. | 75/230 |
| 4,131,460 | A | * | 12/1978 | Orford | 419/17 |
| 5,227,689 | A | | 7/1993 | Shibuya | |
| 5,270,504 | A | * | 12/1993 | Grohs et al. | 200/265 |
| 6,132,487 | A | * | 10/2000 | Mori | 75/247 |
| 6,222,298 | B1 | * | 4/2001 | Saito et al. | 310/233 |
| 6,679,933 | B1 | * | 1/2004 | He et al. | 75/243 |

FOREIGN PATENT DOCUMENTS

| | | | |
|---|---|---|---|
| CH | 82327 | | 9/1919 |
| DE | 289101 | | 12/1915 |
| DE | 845 977 | | 8/1952 |
| DE | 12 73 054 | | 7/1968 |
| DE | 40 24 021 | A1 | 1/1992 |
| DE | 40 25 367 | C2 | 1/1994 |
| DE | 154287 | | 8/2004 |
| DE | 182445 | | 10/2005 |
| DE | 182445 | | 2/2007 |
| JP | 55-14513 | * | 4/1980 |

* cited by examiner

*Primary Examiner*—Roy King
*Assistant Examiner*—Ngoclan T Mai
(74) *Attorney, Agent, or Firm*—William L. Androlia; H. Henry Koda

(57) ABSTRACT

A process for manufacturing a sliding contact piece for medium to high current densities including a step of warm premixing of graphite and plastic binder, a step of cold mixing of the resulting premixture with copper, a step of pressing of the resulting main mixture into the sliding contact piece, and finally a step of sintering of it; and so as to improve the operating characteristics of the sliding contact piece, which is free of any environmentally harmful additives, a metal such as zinc, tin, bismuth or an alloy of such metals is added during the premixing of the graphite and plastic binder.

6 Claims, No Drawings

PROCESS FOR MANUFACTURING A SLIDING CONTACT PIECE FOR MEDIUM TO HIGH CURRENT DENSITIES

BACKGROUND OF THE INVENTION

1. Field of the Invention

The present invention relates to a process for manufacturing a sliding contact piece for medium to high current densities and more particularly to a process used especially to manufacture sliding contact pieces such as carbon brushes employed in electrical machines, especially in motor vehicles, where high current densities occur especially in starters.

2. Prior Art

So as to provide sliding contact pieces for medium to high current densities with favorable properties of both pure carbon contact pieces and metal contact pieces, such materials have long been combined in their manufacture; and in doing so what has been especially sought is an intimate connection of the carbon parts with the metal (DE 154 287 C).

Prior art also includes avoiding the use of additives of lead or antimony, which are contained in common sliding contact pieces and which provide a good cleaning action, cool the sliding contact piece in operation, and make it slide well against a mating contact, which, however, are toxic and harmful to the environment (EP 0525 222 A 1). To accomplish this, an admixture replacing the above additives has been separated from the copper by a layer to prevent alloying, which required special manufacturing measures. Lead substitutes or admixtures which are used are especially tin and/or zinc or an alloy thereof. The environmentally friendly admixtures, preferably tin or zinc, should not simply be mixed with the basic components (copper, graphite), since this would then produce an alloy which would be too hard for the desired purpose and would not have a low enough melting point.

SUMMARY OF THE INVENTION

The object of the present invention is to provide a process for manufacturing sliding contact pieces which do not contain any environmentally harmful additives of lead or antimony but still have favorable operating characteristics, if possible to an increased extent, of sliding contact pieces which otherwise contain the environmentally harmful substances.

The above object is accomplished by unique steps of the present invention for a process for manufacturing a sliding contact piece for medium to high current densities that comprises the steps of warm premixing graphite and plastic binder, cold mixing the resulting premixture with copper, pressing the resulting main mixture into a sliding contact piece, and executing sintering thereon; and in the present invention, during the step of premixing the graphite and plastic binder or during the step of mixing the main mixture with copper, a metal such as zinc, tin, bismuth or an alloy thereof is added.

Furthermore, in the present invention, during the step of premixing the graphite and plastic binder or during the step of mixing the main mixture, an oxide of a metal such as zinc, tin, bismuth or an alloy thereof is added; and during the step of premixing the graphite and plastic binder or during the step of mixing the main mixture, a subcarbonate of a metal such as zinc, tin, bismuth or an alloy thereof is added.

DETAILED DESCRIPTION OF THE INVENTION

In the manufacturing process of a medium to high current densities according to the present invention, either during the premixing of a copper-free matrix, or afterwards during the mixing of the main mixture which is a matrix that does contain copper, a substitute which is based on a metal selected from the group of zinc, tin, bismuth and an alloy of them is added. After subsequent pressing into the sliding contact piece, a sintering or heat treatment is executed. In the process, an alloy is formed with the copper essentially in spots, and although this does not occur in all manufacturing variants, achieving this provides advantages indicated further below and can substantially further increase the endurance of the sliding contact piece.

If the substitute metal from the group of zinc, tin, bismuth and an alloy of them is added during the premixing of graphite and plastic binder, the metal added as a substitute is predominantly incorporated into the graphite/plastic mixture in such a way that it is shielded from the copper which is added later, and alloying with copper does not take place.

However, the substitute can instead also be added afterwards when the main mixture is mixed with copper. When this is done, it is preferable for only enough substitute to be added so that only so-called brass islands are formed, rather than all the copper or copper matrix being converted into a brass alloy. This produces an advantageous focal increase in hardness over that of copper and tin, for example, which can increase the endurance of the sliding contact piece. However, if such a focal increase in hardness is not desired, it can be compensated by minimizing the friction agent that is added.

Instead of the substitutes described above, it is possible to add fine brass powder directly to the main mixture with copper. During the subsequent heat treatment of the sliding contact piece, the temperature can be kept low enough that the brass powder does not form an alloy with the copper.

A substitute that can be added during the premixing of the graphite with plastic binder is an oxide of a metal from the above-described group of zinc, tin, bismuth and an alloy of such metals.

On the other hand, such an oxide can also be added during the mixing of the main mixture.

It is especially preferable to add a subcarbonate of a metal from the above-described group of zinc, tin, bismuth and an alloy of such metals, during the premixing or during the mixing of the main mixture with zinc subcarbonate once again being especially preferred, since it gives the sliding contact piece especially favorable properties, especially endurance. The subcarbonates added in fine form promote the formation of the alloy during the sintering process following the production of the main mixture or during the heat treatment, with a result that the sliding contact pieces have an especially long service life.

In particular, adding about 2 to 5 weight percent of zinc subcarbonate to a main mixture containing about 30 to 70 weight percent copper matrix forms the above-described advantageous brass islands during the subsequent heat treatment.

To form an alloy with the substitute added in the form of the subcarbonate, it is advantageous for the sintering and heat treatment of the pressed sliding contact pieces to be done with steps wherein the first step is to sinter the sliding contact pieces at a temperature in the range from 150 to 250° C. in a nitrogen atmosphere, the second step is to continue the sintering at an increased temperature of 300 to 450° C., the third step is to continue the sintering at a temperature over 450° C. with hydrogen being added to the sintering atmosphere, and finally the fourth step is to form an alloy as a function of time at a temperature over 300° C.

Furthermore, in the present invention, the sliding contact piece, with its advantageous properties, especially endurance, is produced according to one of the following processes according to the invention.

A preferred example of the process according to the present invention is an addition of zinc subcarbonate to a main mixture with copper components in the matrix, and this example will be described below.

Zinc carbonate with a very fine granularity is mixed in to the main mixture. This represents the first step:

$$5\ ZnO.2\ CO_2.4\ H_2O$$

The sliding contact piece is pressed, and then it is sintered in a nitrogen atmosphere in the temperature range from 150 to 250° C., especially 180° C.; and when this is done the first conversion occurs, which is the second step:

$$2\ Zn\ CO_3.3\ ZnO$$

When the temperature is raised further into the range 300 to 450° C., the third step occurs:

$$5\ ZnO$$

Then, molecular hydrogen is added to the sintering atmosphere at a temperature of at least 450° C. up to a final temperature of 600° C., and in the fourth step the zinc oxide decomposes to yield: Zn After that, starting at 300° C., depending on time and temperature, a brass alloy forms by fusion, i.e., without a melting phase, from the zinc with the copper component.

A possible variation is to add zinc oxide to perform the second and third steps.

Another variation is to add zinc to perform the fourth step.

As a matter of principle, it is also possible to modify the above example and add the zinc subcarbonate to a copper-free matrix in the premixing step, with the same processes being followed as described above, however without forming an alloy at the end. However, an alloy formation is especially advantageous for achieving high endurance of the sliding contact pieces as described above. In other respects, the effects that are sought of the additive that is a substitute for lead and antimony can be achieved in all above-described states, including alloy formation.

The invention claimed is:

1. A process for manufacturing a sliding contact piece for medium to high current densities comprising the steps of premixing graphite and plastic binder, mixing the resulting premixture with copper, pressing the resulting main mixture into a sliding contact piece, and executing sintering thereon, wherein during the step of premixing the graphite and plastic binder, a subcarbonate of a metal selected from the group consisting of zinc, tin, bismuth and an alloy thereof is added; and the premixing of the graphite and the plastic binder is done at a temperature higher than the mixing of the premixture with the copper.

2. The process according to claim 1, Wherein the subcarbonate is zinc subcarbonate.

3. The process according to claim 2, wherein about 2 to 5 weight percent of zinc subcarbonate is added to the main mixture containing about 30 to 70 weight percent copper matrix.

4. The process according to claim 1, wherein the process comprising the steps of:

sintering the sliding contact pieces at a temperature in the range from 150 to 250° C. in a nitrogen atmosphere, continuing the sintering at an increased temperature of 300 to 450° C., continuing the sintering at a temperature over 450° C. up to a final temperature of 600° C. with hydrogen being added to the sintering atmosphere, and forming an alloy as a function of time at a temperature over 300° C.

5. The process according to claim 2, wherein the process comprising the steps of:

sintering the sliding contact pieces at a temperature in the range from 150 to 250° C. in a nitrogen atmosphere, continuing the sintering at an increased temperature of 300 to 450° C., continuing the sintering at a temperature over 450° C. up to a final temperature of 600° C. with hydrogen being added to the sintering atmosphere, and forming an alloy as a function of time at a temperature over 300° C.

6. The process according to claim 3, wherein the process comprising the steps of:

sintering the sliding contact pieces at a temperature in the range from 150 to 250° C. in a nitrogen atmosphere, continuing the sintering at an increased temperature of 300 to 450° C., continuing the sintering at a temperature over 450° C. up to a final temperature of 600° C. with hydrogen being added to the sintering atmosphere, and forming an alloy as a function of time at a temperature over 300° C.

* * * * *